US006308420B1

(12) United States Patent
Moser

(10) Patent No.: US 6,308,420 B1
(45) Date of Patent: Oct. 30, 2001

(54) FOLDING KNIFE WITH SPRING AND CAM

(75) Inventor: Rocky Lee Moser, Exeter, CA (US)

(73) Assignee: Taylor Cutlery LLC, Kingsport, TN (US)

( * ) Notice: Subject to any disclaimer, the term of this patent is extended or adjusted under 35 U.S.C. 154(b) by 0 days.

(21) Appl. No.: 09/596,358

(22) Filed: Jun. 17, 2000

(51) Int. Cl.[7] ..... B26B 1/04
(52) U.S. Cl. ..... 30/161; 30/158; 30/160
(58) Field of Search ..... 30/155, 158, 159, 30/160, 161

(56) References Cited

U.S. PATENT DOCUMENTS

| | | | | |
|---|---|---|---|---|
| 812,601 | | 2/1906 | Schrade | 30/159 |
| 821,176 | | 5/1906 | Leland | 30/161 |
| 1,357,398 | | 11/1920 | Haywood | 30/161 |
| 1,512,689 | | 10/1924 | Hermann | 30/161 |
| 1,638,749 | | 8/1927 | Santoyo | 30/161 |
| 2,530,236 | | 11/1950 | Erickson | 30/159 |
| 2,705,832 | | 4/1955 | Mirando | 30/159 |
| 4,190,953 | | 3/1980 | Naifeh | 30/155 |
| 4,502,221 | * | 3/1985 | Pittman | 30/160 |
| 4,535,539 | | 8/1985 | Friedman et al. | 30/161 |
| 4,741,106 | | 5/1988 | Yamagishi | 30/161 |
| 4,888,869 | | 12/1989 | Leatherman | 30/161 |
| 5,153,995 | | 10/1992 | Opinel | 30/161 |
| 5,331,741 | * | 7/1994 | Taylor, Jr. | 30/160 |
| 5,400,509 | | 3/1995 | Collins | 30/161 |
| 5,692,304 | | 12/1997 | Campbell | 30/161 |
| 5,706,584 | | 1/1998 | Bernardini | 30/155 |
| 5,839,194 | * | 11/1998 | Bezold | 30/161 |
| 6,122,829 | * | 9/2000 | McHenry et al. | 30/161 |
| 6,256,887 | * | 7/2001 | Osborne | 30/161 |

* cited by examiner

*Primary Examiner*—Hwei-Siu Payer
(74) *Attorney, Agent, or Firm*—Lalos & Keegan

(57) ABSTRACT

The folding knife includes an elongated handle forming a spacing therebetween. An elongated blade having a working end and a tang at the opposite end within a common plane, a pivot including a pivot axis connecting the tang to the handle to permit the blade to pivot selectively into an open position at which the blade extends outwardly from the handle and into a closed position in which the blade is nested into the spacing. The blade is provided with a cam, that may be a rolling cam, secured to the blade eccentric to the pivot axis and spaced from the plane that includes the blade. An operating spring is secured at one end to the handle and has abutting contact with the cam remote from the end in the handle thus forming force vectors that are arranged selectively to resist the pivoting of the blade to an open position and when in an open position resisting the pivoting of the blade to a closed position.

39 Claims, 1 Drawing Sheet

FOLDING KNIFE WITH SPRING AND CAM

FIELD OF THE INVENTION

The present invention relates generally to knives of the folding kind and, more particularly, knives that have a biased blade.

BACKGROUND

Knives generally and folding knives particularly are well known having been in use in the public for ages. All these prior art knives include common elements. Among these elements are an elongated handle that typically is split into two sides separated from each other to form a spacing. A blade having a working end and a pivot end located in the tang is pivotally disposed at one end of the handle so as to fill the spacing in the handle when in the closed or folded position and when in the open or working position, the knife blade pivots about the end of the handle and extends outwardly. For a spring biased opening folding knife, some form of means is used to retain the blade of the knife recessed in the spacing unless and until either overcome manually or by a mechanism that in either case allows the blade to pivot and move outwardly to attain a working position.

Numerous mechanisms are known in the art for pivoting the knife blade into working position from its recessed or closed position and many use some form of spring means to achieve this pivoting action either alone or with manual assistance. Different forms of such springs have been devised for achieving the desired pivoting action.

For safety reasons it is particularly desirable to retain the blade in a closed recessed position that may or may not be locked in such position. Similarly, when the knife blade is in the open or working position it is completely unacceptable for the blade to prematurely close. Rather the blade when in the open or working position may be locked in that position or be biased against any undesired movement toward closing until it is desired to pivot the blade to its closed or recessed position.

Many prior art knives utilize a spring that may be a metallic leaf spring to provide locking of the blade in open and closed positions such as U.S. Pat. No. 5,706,584 issued to Bernardini.

Another form of a locking device for a foldable knife is disclosed in U.S. Pat. No. 5,692,304 issued to Campbell wherein the leaf spring forms a means for locking the knife as the spring member includes a v-shaped bend to fit into a notch in the tang of the knife.

In the Collins U.S. Pat. No. 5,400,509, a locking mechanism for the knife is provided when in the open position.

The Opinel Patent U.S. Pat. No. 5,153,995 discloses a biasing means for retaining the blade in the open position.

Other patents of various designs include Leatherman U.S. Pat. Nos. 4,888,869, Yamagishi 4,741,106, Friedman et al. 4,535,539, Naifeh 4,190,953.

None of these patents discloses the blade having a rolling cam, an operating spring to provide a force vector capable of resisting the pivoting of the blade from a closed or folded position to an open position and when in open position resisting the pivoting of the blade to a closed or folded position.

SUMMARY OF THE INVENTION

The present invention relates to a folding knife that is biased toward an open position after opening and biased toward remaining in a closed position. The knife includes an elongated handle having opposing separate sides forming a spacing therebetween. An elongated blade having a working end and a tang at the opposite end within a common plane, a pivot including a pivot axis connecting the tang to the handle to permit the blade to pivot selectively into an open position at which the blade extends outwardly from the handle and into a closed position in which the blade is nested into the spacing. The blade is provided with a cam, that may be a rolling cam, secured to the blade eccentric to the pivot axis and spaced from the plane that includes the blade. An operating spring is secured at one end to the handle and has abutting contact with the cam remote from the end in the handle thus forming a force vector that is arranged selectively to resist the pivoting of the blade to a open position and when in an open position resisting the pivoting of the blade to a closed position.

DRAWINGS

FIG. 1 is a plan view, partly in phantom, to show the outline of the handle and also illustrating the blade nested in the closed position within the spacing between the opposing sides of the handle. Further the operating spring rod is shown in an abutting relationship with the eccentric cam to produce a force vector shown that is on the side of the pivot axis proximal to the end of the operating spring rod secured at one end of the handle.

FIG. 2 is a plan view similar to that of FIG. 1, including phantom outlines for the handle and a broken away portion illustrating the second side of the handle. More importantly, the blade is shown to be partially opened wherein the operating spring biasing the blade is bent by the action of the eccentric cam to produce a different force vector on the side of the pivot axis of the blade remote from the end of the operating spring secured within the handle and showing that the illustrated force vector operates to urge the blade to the full open position due to the lever action caused by the eccentricity.

FIG. 3 is a plan view of the knife of the present invention, partly in phantom, showing the blade in the fully extended or open position wherein the eccentric cam, in abutting relationship with the operating spring, produces a new force vector on the side of the pivot axis remote from the end of the operating spring secured in the blade handle to thus maintain the forceful action to retain the blade in the open position.

DESCRIPTION OF THE PREFERRED EMBODIMENT

Figure 1:
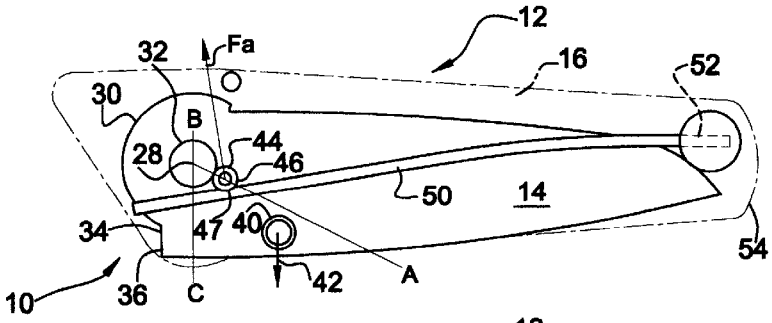

The folding knife of the present invention is represented in the drawings generally by the numeral 10. The folding knife includes an elongated handle 12 and an elongated blade 14. The handle is composed of two identical sides best shown for instance in FIGS. 2 and 5 by a first side 16 and a second side 18. These sides are essentially congruent and are held together by suitable fasteners, not shown, distributed about the surface of the handle 12.

Figure 2:
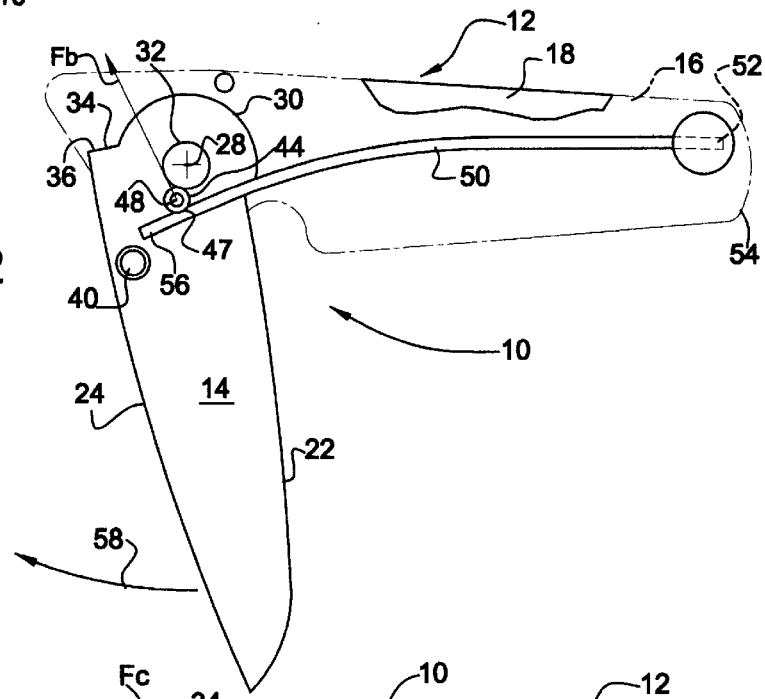
Figure 3:
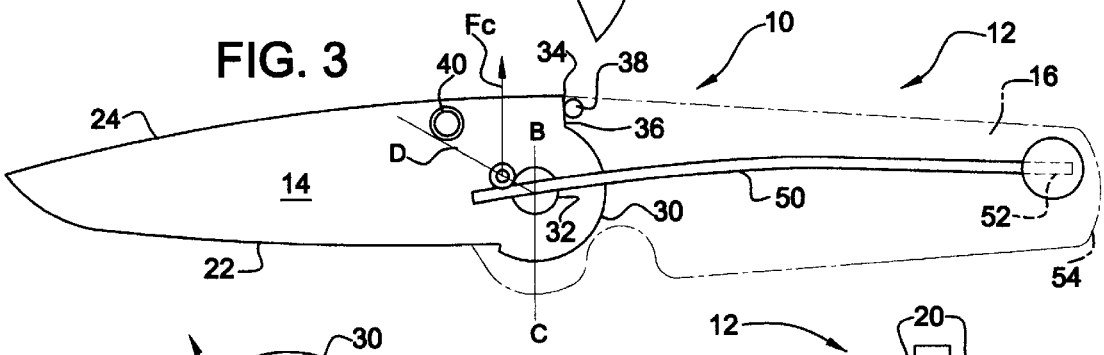
Figure 5:
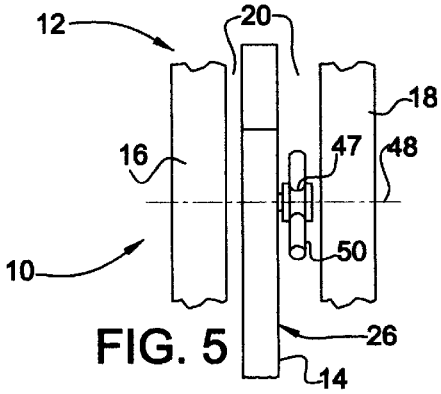
FIG. 5 is a fragmented top view of the knife of the present invention illustrating the pair of spaced identical sides forming the handle and producing the spacing within which the blade is positioned. Also illustrated is the positioning of the cam that is spaced from the plane defining the blade.

As shown in FIGS. 2 and 5, the sides 16 and 18 of the handle 12 are separated in order to form a spacing 20. The spacing 20 accommodates the blade 14 when it is in closed or folded position, as shown particularly in FIG. 1. The blade is of conventional shape, being elongated as it extends from the handle, as shown in FIGS. 2 and 3, and includes a sharpened edge 22 on one side of the blade. The opposite side 24 of the blade may also have a sharpened edge but is usually unsharpened and blunt. The blade is essentially planar having a thickness 26, shown in FIG. 5, except of course for the narrowed sharpened edge 22.

The blade 14 is designed to pivot about a pivot axis 28 around which the blade 14 can rotate in essentially a 180° arc. The pivot axis 28 is suitably secured between the sides 16 and 18 of the handle 12 and accommodates the tang 30 of the blade by means of an opening 32 in the tang of the blade. The blade therefore is free to pivot about the pivot axis 28 upon a desired urging. In addition to the opening 32 in the tang, the tang is provided with a stop abutment 34 formed in the tang to produce a flat planar surface 36, which is designed limit the opening movement of the blade as when strikes stop 38, best shown in FIG. 3. Stop may be a simple rigid pin secured to both sides and 18 of the handle 12. Thus as the blade 14 pivots upwardly from the position as shown in FIG. 2 to the position of FIG. 3, further clockwise movement is prevented as soon as the stop abutment 34 with its flat planar surface 36 strikes the stop 38.

The use of a stop abutment in folding knives is conventional and a placement of the flat planar surface 36 on the tang 30 would be typically in the upper part of the knife blade 14 proximate to the unsharpened or blunt opposite side 24 and typically, but not necessarily, in a plane transverse to the plane of the blade 14 but parallel and distal to the pivot axis 28.

One of the unique aspects of the present invention is the means for biasing the blade 14 to retain it in the closed position shown in FIG. 1 and also to bias it toward the working position as shown in FIG. 3 and urge it toward remaining in that open or working position. In order to begin the process to bring the folding knife from the closed or folded position in FIG. 1 to the operating or working position in FIG. 3, it is necessary for the user to manually grasp the operating extension 40 which is a protuberance of no particular design except that it projects outwardly from the plane of the blade as well as the plane of the drawing of FIG. 1 towards the viewer sufficiently to permit the user to grasp the operating extension 40 to move it in the direction of the arrow 42. This begins the clockwise pivoting motion of the blade 14 around the pivot axis 28. The user must overcome an opposite force resisting such movement that tends to retain the blade 14 in its nested or folded position of FIG. 1. This resisting force to urge the blade 14 toward the nested or closed position is an important safety aspect of the present invention.

To provide the resisting force shown symbolically as force vector Fa, it must be eccentrically formed relative to the axis 28. In order to achieve this force vector Fa, a first required element, a cam 44 in the form of a roller 46 with a curved surface, as shown at 47 of FIG. 5, revolves about cam axis 48, again best shown in FIG. 5. The cam axis 48 is parallel to the pivot axis 28 and also positioned on the blade 14 on a side of the pivot axis that is remote from the tang 30. As best shown in FIG. 5, the curved surface 47 forms an abutting surface that is not only eccentric to the pivot axis 28 but also spaced from the plane of the blade 14 that should be clearly evident from FIG. 5.

In order to complete the biasing of the blade and produce the second required element, the vector force Fa of FIG. 1, an elongated operating spring 50 is provided that may be in the shape of a rod or but which could be flat but, if flat, the abutting surface 47 would have to be appropriately shaped to receive such a flat spring. As shown in the drawings, the rod shaped elongated operating spring 50 is received into the curved abutting surface 47 in which there is rolling contact between the elongated operating spring 50 and the abutting surface 47 of the cam.

As shown in the drawings, the elongated operating spring 50 is anchored at one end 52 to the handle 12 in any suitable manner. The length of the elongated operating spring 50 is essentially nearly coextensive with the overall length of the handle 12 and therefore the anchored end is preferably held at or near one end 54 of the handle 12. The other end 56 is essentially cantilevered and unsupported but always maintains contact with the abutting surface 47 of cam 44.

Figure 4:
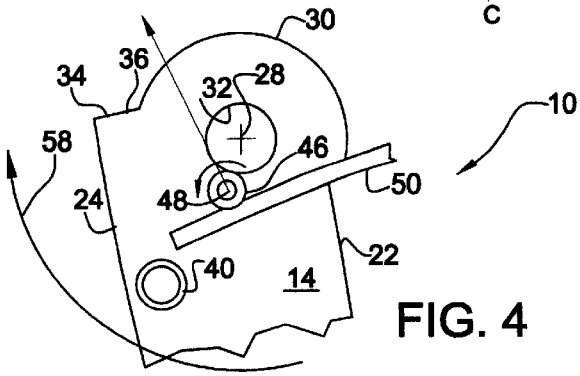
FIG. 4 is an enlarged fragmented view of the position of the blade, the pivot axis and the cam abutting the operating spring similar to that illustrated in FIG. 2. Also shown is the force vector in a direction to urge the blade to the open position as shown by the curved arrow.

In the position as shown in FIG. 1, the force vector Fa passes through the axis 48 of the cam 44 and is spaced from the pivot axis 28 to provide a lever that must be overcome by the user who applies an opening force in the direction of the arrow 42. Upon sufficient force being applied by the user, the force applied in the direction of 42 overcomes the vector force Fa of FIG. 1 and the blade 14 pivots about pivot axis 28 to move in the direction shown by arrow 58 of FIG. 2 and which is also shown as arrow 58 in FIG. 4 moving the blade 14 in a clockwise direction.

It should be noted that the force vector Fa is not static. The direction of the force vector Fa changes from that shown in FIG. 1 as this force vector Fa is overcome by the manual effort of the user. This occurs through movement of operating extension 40 and thereby the axis 48 of cam 44 travels through an arc of the limited angle ABC. At the end of which travel the force vector Fa will pass through the pivot axis 28 and have no further biasing effect.

Further movement of the blade 14 in a clockwise direction by operating extension 40 so that the axis 48 of cam 44 completes and exceeds the arc of angle ABC, a new vector force Fb, as shown in FIG. 2 is created. Vector force Fb is of substantial strength, when viewing the magnitude of the force applied to the operating spring 50 to bend it to the extent shown in FIG. 2. As soon as the force vector Fb comes into existence on the opposite side of pivot axis 28 compared to force vector Fa, vector force Fb, with the continuing biasing of the operating spring 50 applying the force, controls the blade movement. The blade 14, now moves more sharply to the open or extended position shown in FIG. 3. Upon reaching the position shown in FIG. 3, further movement of the blade in a clockwise direction is prevented due to the previously described action between the stop button 34 on the tang 30 and the stop 38 secured to the handle 12.

Upon reaching the fully operating or working position of FIG. 3, the axis 48 of cam 44 will have traversed the arc of angle CBD, shown in FIG. 3 at which time new force vector Fc is created. It should be noted that the new force vector Fc now controls the action of the blade 14 by providing an urging force to resist any movement of the knife in a direction counterclockwise toward a closed or folded position.

It should be clearly recognized that force vector Fc is spaced from the pivot axis 28 and also positioned on the side of the pivot axis 28 remote from the end 52 of the operating spring 50. Thus force vector Fc is continuously active to bias the blade 14 towards the open or working position shown in FIG. 3 and can only be overcome by manual effort of the user to pivot the blade 14 in a counterclockwise manner toward the folded or closed position of FIG. 1.

Accordingly, it should be recognized that force vector Fa and particularly force vector Fc are continuously in operation while the knife is at rest. It should be manifest therefore that vector force Fa is continuously acting to resist the opening of the blade 14 from its nested or closed position and this force Fa can only be overcome by manual force applied to the operating extension 40. On the other hand, the vector force Fc is continuously in action to maintain the blade 14 in the extended or working condition of FIG. 3 and can only be overcome by manual force of the user either applied to the operating extension 40 or to the blunt opposite side 24.

It is believed that the invention is clearly set forth in the foregoing description and the accompanying drawings and the scope of the invention should be solely limited by the appended claims, wherein I claim:

1. A folding knife comprising:

an elongated handle including first and second mutually opposed sides forming a spacing therebetween, an elongated blade having a working end and a tang at an opposite end within a common plane, pivot means having a pivot axis and connecting said tang to said handle to permit said blade to pivot into an open position wherein said blade extends outwardly from said handle and into a closed position wherein said blade is recessed into said spacing, said blade having a cam secured to said blade eccentric to said pivot axis and spaced from said common plane, an operating spring secured at one end to said handle and having abutting contact with said cam remote from said one end forming force vector means, said force vector means being arranged selectively to resist the pivoting of said blade to an open position and when in an open position resist the pivoting of said blade to a closed position.

2. The knife of claim 1 including, said force vector means having a direction remote from said pivot axis.

3. The knife of claim 1 including, said force vector means forming a lever to resist said pivoting of said blade in said open position and said closed position.

4. The knife of claim 1 including, said force vector means being located on one side of said pivot axis when said blade is in the closed position and on an opposite side of said pivot axis when said blade is in an open position.

5. The knife of claim 4 including, said force vector means being on the side of said pivot axis proximal to said one end of said operating spring when said blade is in said closed position.

6. The knife of claim 4 including, said force vector means being on the side of said pivot axis remote from said one end of said operating spring when said blade is in the open position.

7. The knife of claim 4 including, said force vector means being on the side of said pivot axis proximal to said one end of said operating spring when said blade is in said closed position, said force vector means being on the side of said pivot axis remote from said one end of said operating spring when said blade is in the open position.

8. The knife of claim 1 including, said force vector means being spaced from said pivot axis in a direction proximal to said one end of said operating spring when said blade is in the closed position.

9. The knife of claim 1 including, said force vector means being spaced from said one end of said pivot axis in a direction remote to said one end of said operating spring when said blade is in the open position.

10. The knife of claim 1 including, said force vector means being spaced from said pivot axis in a direction proximal to said one end of said operating spring when said blade is in the closed position, said force vector means being spaced from said one end of said pivot axis in a direction remote to said one end of said operating spring when said blade is in the open position.

11. The knife of claim 1 including, said cam rotatable about a cam axis parallel to said pivot axis.

12. The knife of claim 1 including, said cam having an abutting surface for said abutting contact to cooperate with said spring.

13. The knife of claim 1 including, said abutting surface being curved.

14. The knife of claim 1 including, said cam positioned on said blade on a side of said pivot axis remote from said tang.

15. The knife of claim 1 including, said cam rotatable about a cam axis parallel to said pivot axis.

16. The knife of claim 1 including, said cam rotatable about a cam axis parallel to said pivot axis, said force vector means having a direction remote from said pivot axis.

17. The knife of claim 1 including, said cam rotatable about a cam axis parallel to said pivot axis, said force vector means forming a lever to resist said pivoting of said blade in said open position and said closed position.

18. The knife of claim 1 including, said cam rotatable about a cam axis parallel to said pivot axis, said force vector means having a direction remote from said pivot axis, said force vector means being located on one side of said pivot axis when said blade is in the closed position and on an opposite side of said pivot axis when said blade is in an open position.

19. The knife of claim 1 including, said cam rotatable about a cam axis parallel to said pivot axis, said force vector means having a direction remote from said pivot axis, said force vector means being spaced from said pivot axis in a direction proximal to said one end of said operating spring when said blade is in the closed position.

20. The knife of claim 1 including, said force vector means forming a lever to resist said pivoting of said blade in said open position and said closed position, said force vector means being located on one side of said pivot axis when said blade is in the closed position and on an opposite side of said pivot axis when said blade is in an open position.

21. The knife of claim 1 including, said force vector means forming a lever to resist said pivoting of said blade in said open position and said closed position, said force vector means being on the side of said pivot axis proximal to said one end of said operating spring when said blade is in said closed position.

22. The knife of claim 1 including, said force vector means forming a lever to resist said pivoting of said blade in said open position and said closed position, said force vector means being on the side of said pivot axis remote from said one end of said operating spring when said blade is in the open position.

23. The knife of claim 1 including, said force vector means forming a lever to resist said pivoting of said blade in said open position and said closed position, said force vector means being on the side of said pivot axis proximal to said one end of said operating spring when said blade is in said closed position, said force vector means being on the side of said pivot axis remote from said one end of said operating spring when said blade is in the open position.

24. The knife of claim 1 including, said cam rotatable about a cam axis parallel to said pivot axis, said force vector means forming a lever to resist said pivoting of said blade in said open position and said closed position, said force vector means being on the side of said pivot axis proximal to said one end of said operating spring when said blade is in said closed position, said force vector means being on the side of said pivot axis remote from said one end of said operating spring when said blade is in the open position.

25. The knife of claim 1 including, said cam rotatable about a cam axis parallel to said pivot axis, said cam having an abutting surface for said abutting contact to cooperate with said spring, said force vector means having a direction remote from said pivot axis, said force vector means forming a lever to resist said pivoting of said blade in said open position and said closed position, said force vector means being on the side of said pivot axis proximal to said one end of said operating spring when said blade is in said closed position, said force vector means being on the side of said pivot axis remote from said one end of said operating spring when said blade is in the open position.

26. The knife of claim 1 including, said cam positioned on said blade on a side of said pivot axis remote from said tang, said cam rotatable about a cam axis parallel to said pivot axis, said cam having an abutting surface for said abutting contact to cooperate with said spring, said force vector means having a direction remote from said pivot axis, said force vector means forming a lever to resist said pivoting of said blade in said open position and said closed position, said force vector means being on the side of said pivot axis proximal to said one end of said operating spring when said blade is in said closed position, said force vector means being on the side of said pivot axis remote from said one end of said operating spring when said blade is in the open position.

27. A folding knife comprising:

an elongated handle including first and second mutually opposed sides forming a spacing therebetween, an elongated blade having a working end and a tang at an opposite end within a common plane, pivot means having a pivot axis and connecting said tang to said handle to permit said blade to pivot into an open position wherein said blade extends outwardly from said handle and into a closed position wherein said blade is recessed into said spacing, said blade having a cam secured to said blade eccentric to said pivot axis and spaced from said common plane, an operating spring secured at one end to said handle and having abutting contact with said cam remote from said one end, whereby said spring resists the pivoting of said blade to an open position and when in an open position resists the pivoting of said blade to a closed position.

28. The knife of claim 27 including, said cam rotatable about a cam axis parallel to said pivot axis.

29. The knife of claim 27 including, said cam having an abutting surface for said abutting contact to cooperate with said spring.

30. The knife of claim 29 including, said abutting surface being curved.

31. The knife of claim 27 including, said operating spring being an elongated rod.

32. The knife of claim 27 including, said cam positioned on said blade on a side of said pivot axis remote from said tang.

33. The knife of claim 27 including, said operating spring being cylindrical.

34. The knife of claim 27 including, said cam rotatable about a cam axis parallel to said pivot axis, said cam positioned on said blade on a side of said pivot axis remote from said tang.

35. The knife of claim 27 including, said cam rotatable about a cam axis parallel to said pivot axis, said cam having an abutting surface for said abutting contact to cooperate with said spring, said abutting surface being curved.

36. The knife of claim 27 including, said cam having an abutting surface for said abutting contact to cooperate with said spring, said abutting surface being curved, said operating spring being an elongated rod.

37. The knife of claim 27 including, said cam rotatable about a cam axis parallel to said pivot axis, said cam positioned on said blade on a side of said pivot axis remote from said tang, said cam having an abutting surface for said abutting contact to cooperate with said spring, said abutting surface being curved.

38. The knife of claim 27 including, said cam rotatable about a cam axis parallel to said pivot axis, said cam positioned on said blade on a side of said pivot axis remote from said tang, said cam having an abutting surface for said abutting contact to cooperate with said spring, said abutting surface being curved, said operating spring being cylindrical.

39. The knife of claim 27 including, said cam rotatable about a cam axis parallel to said pivot axis, said cam positioned on said blade on a side of said pivot axis remote from said tang, said cam having an abutting surface for said abutting contact to cooperate with said spring, said abutting surface being curved, said operating spring being an elongated rod.

* * * * *